US009074314B2

(12) United States Patent
Zhang et al.

(10) Patent No.: US 9,074,314 B2
(45) Date of Patent: Jul. 7, 2015

(54) CLOTHING STEAM IRONING APPARATUS

(71) Applicants: Yunfeng Zhang, Qinhuangdao (CN); Pinxuan Du, Qinhuangdao (CN)

(72) Inventors: Yunfeng Zhang, Qinhuangdao (CN); Pinxuan Du, Qinhuangdao (CN)

( * ) Notice: Subject to any disclaimer, the term of this patent is extended or adjusted under 35 U.S.C. 154(b) by 0 days.

(21) Appl. No.: 14/356,838

(22) PCT Filed: Nov. 6, 2012

(86) PCT No.: PCT/CN2012/084140

§ 371 (c)(1),
(2) Date: May 7, 2014

(87) PCT Pub. No.: WO2013/067913

PCT Pub. Date: May 16, 2013

(65) Prior Publication Data

US 2014/0373402 A1 Dec. 25, 2014

(30) Foreign Application Priority Data

Nov. 8, 2011 (CN) ..... 2011 2 0437383 U
Nov. 8, 2011 (CN) ..... 2011 2 0437386 U
Feb. 14, 2012 (CN) ..... 2012 2 0046782 U

(51) Int. Cl.
*D06F 75/36* (2006.01)
*D06F 87/00* (2006.01)
*D06F 75/20* (2006.01)
(Continued)

(52) U.S. Cl.
CPC ..... *D06F 87/00* (2013.01); *D06F 75/36* (2013.01); *A47L 11/33* (2013.01); *D06F 75/20* (2013.01); *D06F 75/10* (2013.01); *D06F 75/30* (2013.01); *D06F 75/38* (2013.01); *D06F 69/00* (2013.01); *D06F 75/00* (2013.01); *D06F 79/02* (2013.01)

(58) Field of Classification Search
CPC ..... D06F 71/32; D06F 71/34; D06F 71/36; D06F 75/00; D06F 75/30; D06F 75/40; D06F 75/36; D06F 75/38; D06F 87/00; A47L 11/30; A47L 11/33; A47L 11/34; A47L 11/4086; A47L 11/4088; A47L 11/4097
USPC ..... 38/14, 15, 75, 79, 88, 93; 68/5 R, 222; 15/241, 314, 319, 320, 321, 322, 328, 15/344
See application file for complete search history.

(56) References Cited

U.S. PATENT DOCUMENTS 3,262,146 A * 7/1966 Hays ..... 15/321
3,721,026 A * 3/1973 McCallum ..... 38/75
(Continued)

FOREIGN PATENT DOCUMENTS

CN 201162146 12/2008
CN 101956316 1/2011
(Continued)

OTHER PUBLICATIONS

International Search Report for related application PCT/CN2012/084140, mailed Feb. 7, 2013.

*Primary Examiner* — Ismael Izaguirre
(74) *Attorney, Agent, or Firm* — McDermott Will & Emery LLP

(57) ABSTRACT

An apparatus for steam ironing clothes is provided. The clothing steam ironing apparatus includes an ironing component with an ironing panel, steam ejection holes for ejecting steam to iron a clothing and air suction holes for generating a suck force on the clothing are provided in the ironing panel.

20 Claims, 7 Drawing Sheets

(51) Int. Cl.

| | |
|---|---|
| ***D06F 75/10*** | (2006.01) |
| ***D06F 75/30*** | (2006.01) |
| ***D06F 75/38*** | (2006.01) |
| ***D06F 69/00*** | (2006.01) |
| ***D06F 75/00*** | (2006.01) |
| ***D06F 79/02*** | (2006.01) |
| *A47L 11/33* | (2006.01) |

(56) References Cited

U.S. PATENT DOCUMENTS

| | | | | |
|---|---|---|---|---|
| 4,583,260 | A * | 4/1986 | Zai | 15/328 |
| 4,976,005 | A * | 12/1990 | Graye | 15/322 |
| 5,613,271 | A * | 3/1997 | Thomas | 15/321 |
| 6,895,632 | B2 * | 5/2005 | Murray | 15/344 |
| 7,389,597 | B1 | 6/2008 | Chen | |
| 7,516,565 | B1 | 4/2009 | Tsen | |
| 2007/0143951 | A1 * | 6/2007 | Wu | 15/320 |
| 2008/0263812 | A1 * | 10/2008 | Williams et al. | 15/322 |
| 2013/0086954 | A1 * | 4/2013 | Zhang | 68/5 B |
| 2013/0219758 | A1 * | 8/2013 | Jiang et al. | 38/144 |

FOREIGN PATENT DOCUMENTS

| | | |
|---|---|---|
| CN | 201962532 | 9/2011 |
| CN | 202323512 | 7/2012 |
| CN | 202323515 | 7/2012 |
| CN | 202430546 | 9/2012 |

* cited by examiner

CLOTHING STEAM IRONING APPARATUS

REFERENCE TO RELATED APPLICATIONS

This application is a National Phase Application filed under 35 USC 371 of International Application No. PCT/CN2012/084140, filed on Nov. 6, 2012, which claims the benefit and priority from Chinese Patent Application No. 201120437383.0, filed on Nov. 8, 2011, Chinese Patent Application No. 201120437386.4, filed Nov. 8, 2011, and Chinese Patent Application No. 201220045782.9, filed Feb. 14, 2012, the disclosures of which are incorporated herein by reference in their entirety.

TECHNICAL FIELD

The present disclosure relates to a clothing steam ironing apparatus, particularly to one suitable for ironing hanging clothing while performing cleaning and dust-removal operations.

BACKGROUND

Steam ironing for clothing has advantages of high efficiency and no adverse influence to the surface and texture of the clothes. Further, a hanging arrangement for steam ironing is especially convenient due to there is no flat bench. A clothing steam ironing apparatus in the prior art includes a mount including a steam generating device therein, a steam pipe led from the mount, an ironing head connected at an end of the steam pipe led, and a vertical telescopic pole bracket provided on the mount. This clothing steam ironing apparatus could be only used for clothing ironing, while performing no useful functions like dust elimination. Accordingly, this ironing apparatus only has a single function. Additionally, since there is no support for the hung clothing at its back side during an ironing operation for this hung clothing, it is difficult to perform a smoothly ironing operation on the clothing, which affects efficiency and effect of the ironing operation. The clothing steam ironing apparatus in the prior art is equipped with a fan, and air suction holes are provided on an ironing panel, and the hung clothing is absorbed on the ironing panel under the interaction between the fan and the air suction holes, so that the clothing steam ironing apparatus may perform an ironing operation on the hung clothing easily. However, arrangement design of the steam chamber and an air suction chamber in the ironing apparatus impedes smooth flowing of the air in certain extent, which affects the ironing operation as well as absorption performance and dust removal performance. Further, due to adoption of an axial flow fan below an ironing head, suction strength of the fan becomes weak, which also affects the ironing operation as well as absorption performance and dust removal performance. Moreover, it also causes difficulty in a smooth discharge of the humid heat air from the suction chamber, which brings detrimental effect on a motor of the fan.

SUMMARY

The present disclosure provides a clothing steam ironing apparatus and it has been made to overcome or alleviate at least one aspect of the above mentioned disadvantages.

In order to overcome the above mentioned disadvantages, the present disclosure provides a clothing steam ironing apparatus that performs a cleaning of the clothing, i.e., having a cleaning performance, which may be operated easily, and has high efficiency, a good ironing effect, and a cleaning performance.

According to an aspect of the present disclosure, there is provided a clothing steam ironing apparatus having a cleaning performance of the clothing. The apparatus includes a mount including a steam generating device therein, the mount being equipped with a vertical telescopic pole bracket, a steam pipe connected with the steam generating device at one end and connected with an ironing head at the other end, and, a controlling electric switch provided on the ironing head. The ironing head includes a steam chamber, and the steam chamber is branched into one left steam passage and one right steam passage in an ironing head housing, and the two steam passages are joined at rear ends to form an ironing head steam inlet interface communicating with the steam pipe. The front ends of the two steam passages are communicated with an ironing head steam collection chamber formed by the ironing head housing and an oblate ironing panel, and inner sides of the two steam passages and the ironing head housing form an air suction chamber positioned at the middle of the ironing head. Steam ejection holes communicating with the steam collection chamber of the ironing head are dispersedly formed in an upper portion of the ironing panel, and air suction holes communicating with the air suction chamber of the ironing head are formed in a lower portion of the ironing panel, and a dust collection casing is provided in the air suction chamber of the ironing head, an air inlet port provided at a front end of the dust collection casing is connected with the air suction holes on the ironing panel, an air discharge port equipped with a filter screen is provided on a rear end of the dust collection casing, a centrifugal fan is provided behind the dust collection casing, and the centrifugal fan is formed by centrifugal impellers positioned in the front and a motor for the fan positioned in the rear, air discharge ports are provided on an upper surface and a lower surface of the ironing head housing corresponding to the positions of the centrifugal impellers, and motor air vents are provided on the upper surface and the lower surface of the ironing head housing corresponding to the position of the fan motor.

A transverse groove separating the steam ejection holes from the air suction holes is formed at a front plate of the ironing panel and positioned between the steam ejection holes and the air suction holes.

The controlling electric switch provided on the ironing head is a multi-position slide switch.

The steam passage housing in the ironing head is provided as a thermal insulation housing. The ironing panel is an electric heat ironing panel.

The steam ejection holes and the air suction holes are circular holes. The steam ejection holes are arranged as a curve row along an upper edge of the ironing panel, and the air suction holes are arranged as a curve row along a lower edge of the ironing panel.

The air suction holes are formed as one transverse elongate air suction. The air suction holes are formed as one curve elongate air suction along the lower edge of the ironing panel.

According to another aspect, the present disclosure provides a clothing steam ironing apparatus, which includes an ironing head for ironing clothing to be ironed, and a steam chamber and an air suction chamber are provided in the ironing head. The steam chamber includes two steam passages extending from an ironing head housing and a steam collection chamber, rear ends of the steam passages are formed into one passage and connected with a steam pipe, front ends of the steam passages are connected with the steam collection chamber. The steam collection chamber is communicated with steam outlets in panel of the ironing head. The air suction chamber is formed by inner sides of the steam passages and the housing of the ironing head. The air suction chamber is communicated with air suction holes of the panel of the ironing head, and a dust collection casing is provided in the air suction chamber for collecting dust from the air suction holes.

Preferably, the panel of the ironing head includes a groove by which the panel is divided into two parts as an upper part and a lower part. The steam holes are provided on the upper part of the panel of the ironing head, and the air suction holes are provided on the lower part of the panel of the ironing head.

The steam chamber of the present disclosure includes one left steam passage and one right steam passage, and the air suction chamber is formed to have a triangular shape in the middle the steam head housing, so that the steam passage and the air suction passage are smooth and clear, thereby improving the ironing effect, the suction effect, and the dust-removing effect. The mounting position of the fan is optimized to facilitate the air discharging of the suction chamber and the air venting of the motor, so that the performance of the ironing apparatus may be improved.

According to the present disclosure, the steam ejection holes are formed in an upper portion of the ironing panel, and air suction holes are formed in a lower portion of the ironing panel, so that the apparatus may firstly remove the dust on the clothing, and then iron the clothing. It is advantageous for cleaning the clothing and then ironing the clothing.

According to the present disclosure, the groove separating the steam ejection holes from the air suction holes is arranged so that the steam is blocked into the air suction chamber via the air suction holes. Accordingly, the hot humid steam would not be condensed into water and thereby flow into the dust collection chamber, and would not bring the adverse effects on the motor of the fan.

According to the present disclosure, the controlling electric switch is a multi-position slide switch, so that the apparatus may be controlled in various modes, i.e., it may be controlled to clean the clothing only, or iron the clothing only, or both clean and iron the clothing.

According to the present disclosure, the steam passage housing in the ironing head is provided as thermal insulation housing so that it ensures the ironing steam from the steam ejection holes has high temperature and the disadvantageous influence on the motor of the fan by the steam is reduced/minimized.

According to the present disclosure, the ironing panel is embodied as an electric heat ironing panel that cooperates with the air suction of the air suction holes in order to timely minimize (or even eliminate) the humid air on the clothing produced by the ironing.

According to the present disclosure, the steam ejection circular holes are arranged as a curve row and the air suction holes are arranged as one elongated air suction, which is particularly suitable for the steam ironing, the clothing absorption, and the dust removing.

The present disclosure is particularly suitable for ironing of a hanged clothing, and due to an absorption function of the ironing head, it is advantageous for the clothing ironing, the sterilization, and the dust removing by the heat steam.

According to another aspect, the present disclosure provides a vertical clothing steam ironing apparatus. The apparatus includes a mount including a steam generating device therein and an ironing head, the mount being equipped with a vertical telescopic pole bracket, a controlling electric switch being provided on the ironing head, the ironing head is connected with the mount via a flexible outer sleeve, and the ironing head includes an oblate ironing panel, steam ejection holes communicating with a steam chamber of the ironing head are provided in an upper portion of the ironing panel, air suction holes communicating with an air suction chamber of the ironing head are formed in a lower portion of the ironing panel. The apparatus further includes a transverse steam blocking groove that is provided between the steam ejection holes and the air suction holes on a front plate of the ironing panel, and a dust collection device is provided in the mount, an air discharge port of the dust collection device is connected with a fan, an air discharge port cooperating with the fan is provided on the mount, a flexible steam pipe and an air suction pipe are provided in the flexible outer sleeve, an upper end of the steam pipe is connected with the steam chamber of the ironing head, and a lower end of the steam pipe is connected with a steam outlet of the steam generating device in the mount, an upper end of the air suction pipe is connected with the air suction chamber of the ironing head, and a lower end of the air suction pipe is connected with an air inlet of the dust collection device in the mount.

A condensation water collection ring is provided at a lower portion of the steam chamber in the ironing head, and a condensation water backflow pipe is provided in the flexible outer sleeve, and the upper end of the steam pipe is connected with a steam outlet above the condensation water collection ring, an upper end of the condensation water backflow pipe is connected with a condensation water backflow inlet below the condensation water collection ring. A lower end of the condensation water backflow pipe is connected with a storage water tank of the steam generating device in the mount.

The steam ejection circular holes are arranged as a curve row along upper an edge of the ironing panel, and the air suction holes are arranged as an elongate air suction hole along lower edge of the ironing panel.

A dust collection casing is provided in the air suction chamber of the ironing head, air inlets are provided on a front portion of the dust collection casing and connected with the air suction holes on the ironing panel, and an air discharge port equipped with a filter screen is provided on a rear portion of the dust collection casing.

A sliding plate type air suction adjustment door is provided on the ironing head. The ironing panel includes an electric heat ironing panel. A steam ejection hole extending pipe is provided in an inner side of the ironing panel and connected with the steam ejection holes.

According to the present disclosure, a fan is provided in the mount, and the air suction holes cooperating with the fan are provided on the ironing panel, the above components form an absorption and dust-removing device for the hanged clothing. When the ironing panel irons the clothing, the panel is in a close contact with the clothing, so that the hanged clothing is ironed and flattened easily, which improves efficiency of the ironing and the ironing effect. Moreover, dust on the clothing will be removed due to the absorption function of the apparatus.

According to the present disclosure, the condensation water collection ring is provided in the ironing head, so that the condensation water in the ironing head flows into the storage water tank of the steam generating device via the condensation water backflow pipe. This arrangement enables a minimization that the condensation water reflows through the steam pipe to decrease temperature of the steam, and that the steam is more humid by the condensation water.

The steam ejection holes and the air suction holes are arranged on the upper portion and the lower portion respectively, so that the apparatus may be operated such that the dust is removed firstly, and then the clothing is ironed, thereby ensuring the dust-removing effect and the ironing effect. Moreover, the elongate air suction hole is suitable for dust removing.

The dust collection device is arranged in the mount for filtering the suction air, it is advantageous for providing a good working environment for the fan and a cleaning of the air from the apparatus indoor. The dust collection device is arranged in the ironing head for filtering the air suctioned into the ironing head, so that the air suctioned in the ironing head is cleaned.

The air suction adjustment door is arranged in the ironing head for adjusting the suction force on the clothing by the ironing head, so that it is suitable to process the clothing with different material.

According to the present disclosure, the ironing panel includes an electric heat ironing panel, which improves the ironing effect and may dry the clothing wetted by the steam.

According to the present disclosure, the steam ejection hole extending pipe is provided in an inner side of the ironing panel and connected with the steam ejection holes, the ironing steam with condensation water in the steam chamber is restrained to eject from the steam chamber, which is advantageous for the ironing effect.

According to another aspect, the present disclosure provides a vertical clothing steam ironing apparatus. The apparatus includes a mount for supporting the clothing steam ironing apparatus, a dust collection casing is provided in the mount, and the dust collection casing includes a front plate and a rear plate, wherein the front plate is arranged in the front of the mount and air discharges are provided on the rear plate when the dust collection casing is mounted in the mount. The apparatus further includes an air discharge passage formed by the rear plate of the dust collection casing and a plate having a groove cross-section, impellers provided in the discharge passage, and a motor connected with the impellers through the plate having the groove cross-section for driving the impellers, and both ends of the air discharge passage are respectively connected with air discharge ports of the housing of the mount.

In one embodiment, a steam chamber is provided in the ironing head, and a condensation water collection ring is provided at a lower portion of the steam chamber, an upper end of a steam pipe is provided to be connected with steam outlets of the condensation water collection ring, and the steam pipe is communicated with the steam chamber, a condensation water backflow inlet of the condensation water collection ring is connected with an upper end of a condensation water backflow pipe, and a lower end of the condensation water backflow pipe is connected with a storage water tank in the mount.

According to another aspect, the present disclosure provides a vertical clothing steam ironing apparatus having cleaning and dust-removing performance. The apparatus includes a mount including a steam generating device therein and an ironing head, the mount being equipped with a vertical telescopic pole bracket, and a storage water tank connected with the steam generating device. An internal space of the ironing head is separated as a steam chamber and an air suction chamber by a separation plate, and steam ejection holes communicating with the steam chamber and air suction holes communicating with the air suction chamber are provided on the ironing panel of the ironing head. The apparatus further includes a dust collection casing provided in the front of the mount, a front plate of the dust collection casing is made of transparent material, an air vent of the dust collection casing is provided on a rear plate of the dust collection casing, and a filter screen is provided on the air vent of the dust collection casing. The apparatus further includes a fan formed by a motor and impellers that is provided in the mount and located at a position corresponding to a position of the air vent of the dust collection casing, and the impellers are provided in an air discharge passage formed by a rear plate of the dust collection casing and a plate having a groove cross-section, both ends of the air discharge passage are connected with air discharge ports provided on the housing at both sides of the mount respectively, one end of a flexible steam pipe is connected with a steam chamber of the ironing head, and the other end of the flexible steam pipe is connected with steam outlet of the steam generating device. Moreover, one end of a flexible air suction pipe is connected with the air suction chamber of the steam head, and the other end of the flexible steam pipe connects with an air inlet port of the dust collection casing provided on an upper portion of the dust collection casing.

The clothing steam ironing apparatus further includes two rotary button controlling switches are provided on the mount, and one of the two rotary controlling switches is in an electric connection with the motor of the fan, and the other of the two controlling switches is in an electric connection with the steam generating device. The steam pipe and the air suction pipe are provided in an outer flexible protective pipe. A pipe connection joint is provided on the mount, and the pipe connection joint is formed by a steam pipe connection joint and an air suction pipe connection joint extending out of a disk surface of a disk body at both ends thereof.

A dust collection casing and a fan are provided in the mount of the present disclosure, and are connected with the ironing head having air suction holes via the air suction pipe, and the above components form a sorption device for the hanged clothing. When the ironing panel irons the clothing, the panel is in a close contact with the clothing, so that the hanged clothing is ironed/flattened easily, and it improved the efficiency of the ironing and the ironing effect. Moreover, the dust on the clothing is removed due to the sorption function of the apparatus.

The dust collection, the fan, and the air discharge passage in the mount are reasonable structures. Moreover, the apparatus has the following advantages: a desirably strong air suction force, a good dust collection effect, a and smooth air discharge. Moreover, the heat humid air is restrained to flow into the mount for eliminating adverse effect on the motor.

According to the present disclosure, the fan and the steam generating device are controlled independently by two rotary button controlling switches, and the suction force and the steam quantity are controlled easily, so that the apparatus meets the ironing and cleaning requirements of the clothing with differential material. It is advantageous for controlling the apparatus and operating the apparatus.

According to the present disclosure, the outer protective pipe and the pipe connection joint are arranged so that it is advantageous for connecting and assembling the steam pipe, the air suction pipe and the outer protective pipe, and improving the product safety during operation.

DETAILED DESCRIPTION OF THE DRAWINGS

Figure 1:
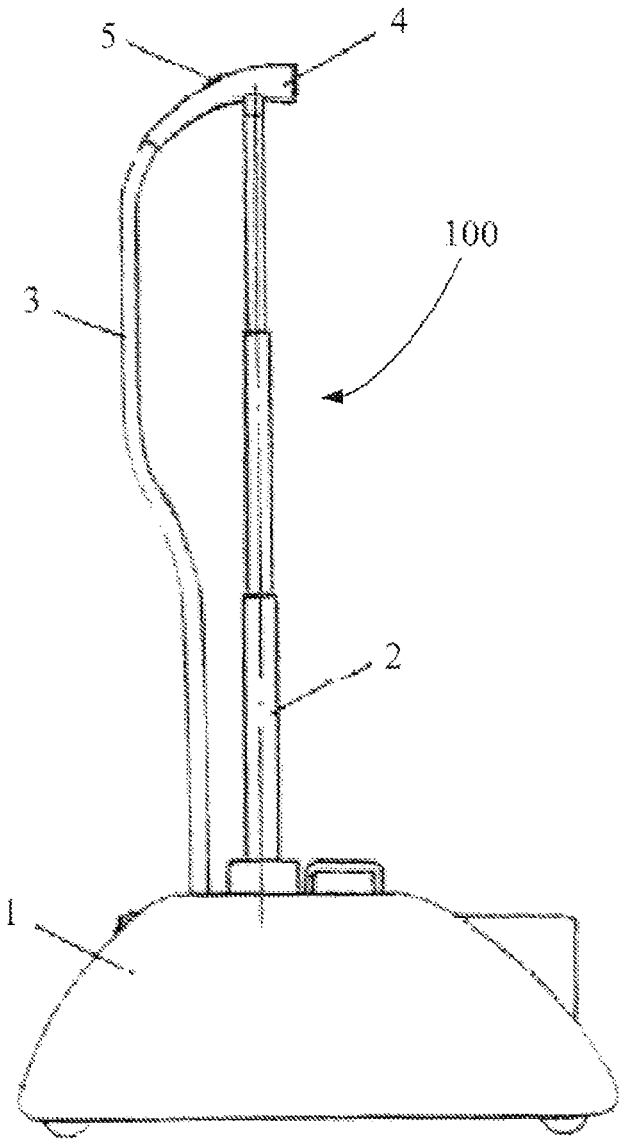
FIG. 1 is a schematic elevated side-view of an overall configuration of the clothing steam ironing apparatus according to a first exemplary embodiment of present disclosure.

Exemplary embodiments of the present disclosure will be described hereinafter in detail with reference to the attached drawings, wherein the like reference numerals refer to the like elements throughout the specification. These embodiments should not be construed as being limited to the embodiment set forth herein, rather for illustrative purposes.

In description hereafter, "clothing steaming ironing apparatus" may be referred to as "vertical clothing steam ironing apparatus", "clothing" may be referred to as "clothes," and "garment." Thus, though presented in different expressions, the two terms have substantially same meaning

First Exemplary Embodiment

As illustrated in FIGS. 1-4, according to the first exemplary embodiment of present disclosure, a clothing steam ironing apparatus 100 includes an ironing head 4 for ironing clothing to be ironed, and a steam chamber and an air suction chamber are provided in the ironing head. The steam chamber includes two steam passages extending from an ironing head housing and a steam collection chamber, rear ends of the steam passages are formed into one and connected with a steam pipe 3, front ends of the steam passages are connected with the steam collection chamber, and the steam collection chamber is communicated with steam discharges 8 of a panel 7 of ironing head 4. The air suction chamber is formed by inner sides of the steam passages and a housing 6 of ironing head 4, and the air suction chamber is communicated with air suction holes 9 of panel 7 of the ironing head, a dust collection chamber 10 is provided in the air suction chamber for collecting dust from air suction holes 9.

Figure 2:
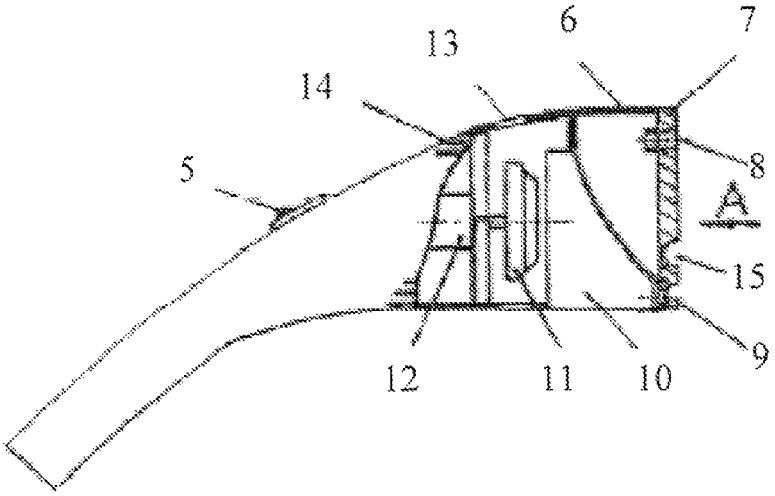
FIG. 2 illustrates a side view and a partial internal view of an ironing head of the clothing steam ironing apparatus shown in FIG. 1.

More specifically, as illustrated in FIGS. 1-2, as shown in FIG. 1, clothing steam ironing apparatus 100 having cleaning performance includes a mount 1, and road wheels may be arranged at the floor of the mount dependent on the requirements, a handle also may be arranged on the mount, the above components help easy movement of the ironing apparatus. A steam generating device is arranged internally to mount 1, and the steam generating device may be embodied as a storage water tank with an electric heating tube therein. A steam pipe 3 is connected with a steam outlet (not shown) of the steam generating device in mount 1 and stretches from mount 1, and the steam pipe is a flexible heat-resisting pipe. The other end of the steam pipe 3 is connected with an ironing head 4. A controlling electric switch 5 is provided on the ironing head 4, and controlling electric switch 5 is a multi-position slide switch so that apparatus 100 may be operated in various modes of operation. Mount 1 is equipped with a vertical telescopic pole bracket 2, and the bracket 2 is formed by plurality of section hollow rods nested in assembly. As the telescopic function of the bracket 2, it is advantages for storage of the apparatus when apparatus 100 stands idle and for adjustment of the height of the bracket to facilitate the ironing operation. A U-shaped bracket head is provided on the upper end of telescopic pole bracket 2 and on which ironing head 4 may be placed.

Figure 3:
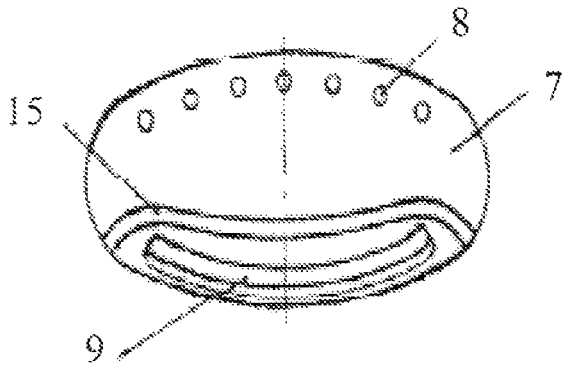
FIG. 3 is a front view of the ironing head as seen from the A-direction shown in FIG. 2.
Figure 4:
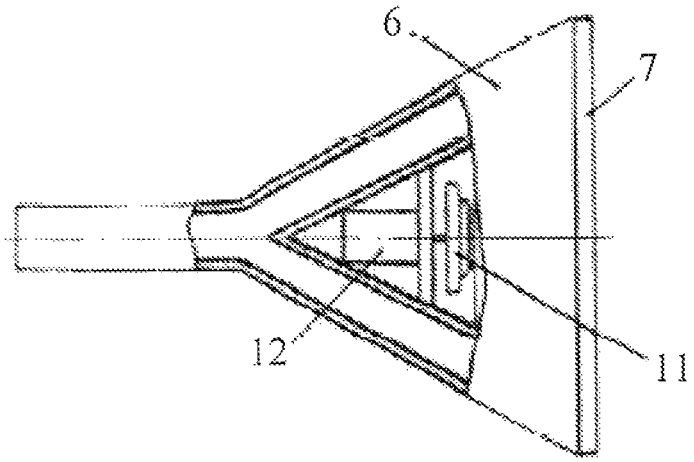
FIG. 4 illustrates a top view and another partial view of the ironing head of the clothing steam ironing apparatus shown in FIG. 1.

As illustrated in FIGS. 2-4, ironing head 4 according to the present disclosure includes ironing head housing 6 with its rear portion curved downwardly to form a trumpet shape, and ironing panel 7 of an oblate shape is arranged on a front portion of ironing head housing 6. Ironing panel 7 is an electric heat ironing panel with an electric heat element (not shown) therein. Ironing head 4 includes a steam chamber. The steam chamber is branched as one left steam passage and one right steam passage in ironing head housing 6, and the two steam passages are joined at rear ends to form an ironing head steam inlet interface that is communicated with steam pipe 3. Front ends of the two steam passages are communicated with an ironing head steam collection chamber formed by ironing head housing 6 and ironing panel 7. Inner sides of the two steam passages and ironing head housing 6 of ironing head 4 form an air suction chamber of a triangle shape positioned at the middle of ironing head 4, steam ejection holes 8 communicating with the ironing head steam collection chamber are dispersedly formed in an upper portion of ironing panel 7, air suction holes 9 communicating with the ironing head air suction chamber are formed in a lower portion of ironing panel 7. Moreover, a dust collection casing 10 is provided in the air suction chamber of ironing head 4, and dust collection casing 10 is a vertical flat shape casing opened at a front end and a rear end. Dust collection casing 10 in whole may be inserted into the air suction chamber from the lower portion of ironing head housing 6. After dust collection casing 10 is inserted into the air suction chamber, an air inlet port provided at a front end of dust collection casing 10 is connected with air suction holes 9 on ironing panel 7, and an air discharge port equipped with a filter screen is provided on a rear end of dust collection casing 10. A centrifugal fan is provided behind dust collection casing 10, and the centrifugal fan is formed by centrifugal impellers 11 positioned in the front and a motor 12 for the fan positioned in the rear. Moreover, air discharge ports 13 are provided on an upper surface and a lower surface of ironing head housing 6 of ironing head 4 corresponding to the positions of centrifugal impellers 11, and motor air vents 14 are provided on the upper surface and the lower surface of housing 6 of ironing head 4 corresponding to the position of a fan motor 12.

According to the present disclosure, a transverse groove 15 separating the steam ejection holes 8 from air suction holes 9 is formed at a front plate of ironing panel 7 and positioned between steam ejection holes 8 and air suction holes 9, and both ends of transverse groove 15 is extended to the side edges of ironing panel 7.

According to the present disclosure, in one exemplary embodiment, steam ejection holes 8 are suitably embodied as circular holes. As shown in FIG. 3, steam ejection holes 8 are arranged as a curve row along upper edge of ironing panel 7.

According to the present disclosure, in one exemplary embodiment, air suction holes 9 may be circular holes, and air suction holes 9 are arranged as a curve row along lower edge of ironing panel 7.

According to the present disclosure, air suction holes 9 may be formed as one transverse elongate air suction, or as one curve elongate air suction along lower edge of ironing panel 7.

In the embodiment as shown in figures, steam ejection holes 8 are circular holes arranged as a curve row along upper edge of ironing panel 7, and air suction holes 9 are formed as one curve elongate air suction along lower edge of ironing panel 7.

According to the present disclosure, a steam passage housing in ironing head 4 may be suitably embodied as thermal insulation housing. As shown in FIG. 4, the thermal insulation housing may be provided as a double-layers structure having an air chamber, or may be provided as a structure of the housing with a thermal insulation material layer.

As shown in FIGS. 2 and 3, air suction holes 9 are provided in a groove on the front plate of ironing panel 7.

Second Exemplary Embodiment

Figure 5:
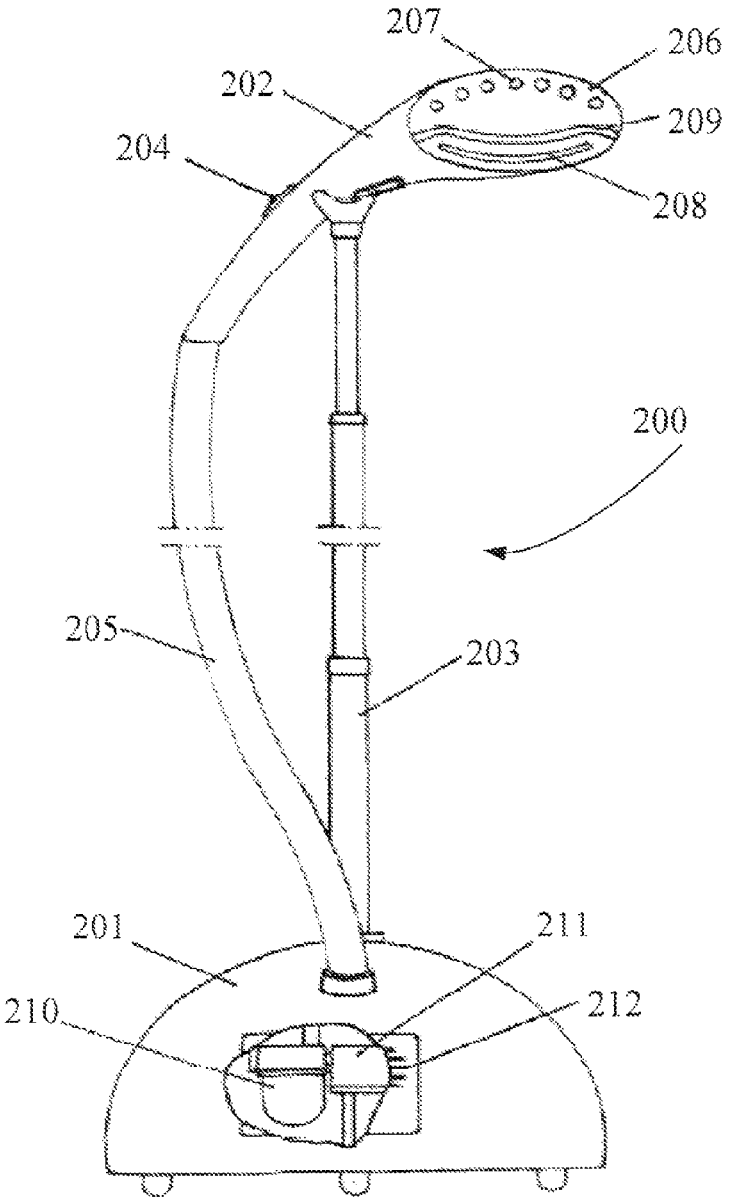
FIG. 5 is a schematic elevated front-view and a partial interval view of a mount of a configuration of the clothing steam ironing apparatus according to a second exemplary embodiment of present disclosure.
Figure 6:
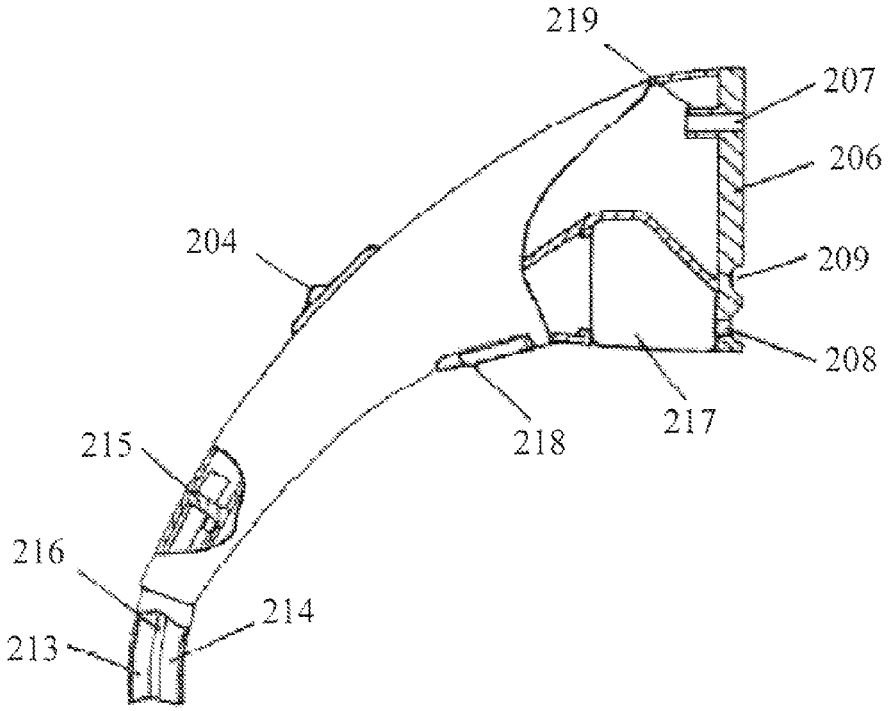
FIG. 6 is a schematic cross-section view of an ironing head of the clothing steam ironing apparatus shown in FIG. 5.

As shown in FIGS. 5 and 6, a vertical clothing steam ironing apparatus 200 includes a mount 201 and an ironing head 202, and, a handle and road wheels may be arranged on mount dependent on the requirements for helping easy movement of ironing apparatus 200. A steam generating device is arranged internally to mount 201, and includes a storage water bank and a filling water sink. The steam generating device is heated with an electric heating tube therein. Mount 201 is equipped with a vertical telescopic pole bracket 203, which is formed by a plurality of section hollow rods nested in assembly. A controlling electric switch 204, which is provided on ironing head 202, is a multi-position slide switch so that apparatus 200 may be operated in various modes, i.e., cleaning and dust removing, steam ironing, the panel electric heating and cleaning and dust removing, steam ironing while electric heating of the panel. Ironing head 202 is connected with mount 201 via a flexible outer sleeve 205, which is a flexible bellow. Moreover, ironing head 202 includes an ironing panel 206 of an oblate shape, and may be an electric heat ironing panel that includes an inner plate and an outer electric heat ironing panel covered at outside of the inner plate. Steam ejection holes 207, which communicate with a steam collection chamber of ironing head 202, are provided in an upper portion of ironing panel 206. Air suction holes 208, which are connected with the air suction chamber of ironing head 202, are formed in a lower portion of ironing panel 206. A transverse steam blocking groove 209 is provided between steam ejection holes 207 and air suction holes 208 on the front plate of ironing panel 206 for reducing the steam ejected from steam ejection holes 207 through air suction holes 208 into the ironing head air suction chamber. Steam ejection holes 207 are circular holes arranged as a curve row along upper edge of ironing panel 206, and a steam ejection hole extending pipe 219 is provided in an inner side of ironing panel 206 and is connected with steam ejection holes 207. Air suction holes 208 are arranged as an elongate air suction hole along lower edge of ironing panel 206. Steam blocking groove 209 is a transverse groove, both ends of the groove extend to the edge of ironing panel 206, and the transverse groove has a curve cross-section or a trapezium cross-section. A dust collection device 210 is provided in mount 201, and is formed by a closed casing and a filter screen provided in the close casing, which has an air discharge port and an air discharge port. The air discharge port of dust collection casing 210 is connected with a fan 211, and an air discharge port 212 cooperating with fan 211 is provided on the housing of mount 201, a flexible steam pipe 213 and an air suction pipe 214 are provided in flexible outer sleeve 205, an upper end of steam pipe 213 is connected with the steam chamber of ironing head 202, and a lower end of steam pipe 213 is connected with a steam outlet of the steam generating device in mount 201. An upper end of air suction pipe 214 is connected with the air suction chamber of ironing head 202, and a lower end of air suction pipe 214 is connected with an air inlet of the dust collection device 210 in mount 201.

According to the present disclosure, a sliding plate type air suction adjustment door 218 is provided on ironing head 202. Degrees of an opening of a door adjustment hole communicating with the air suction chamber of ironing head 202 may be adjusted by moving adjustment door 218, so that suction force of the ironing head 202 may be adjusted.

According to the present disclosure, a condensation water collection ring 215 is provided at a lower portion of the steam chamber in ironing head 202, and a flexible condensation water backflow pipe 216 is provided in flexible outer sleeve 205. The above components form a steam chamber condensation water backflow pipe structure. In the steam chamber condensation water backflow pipe structure, the upper end of steam pipe 213 is connected with a steam discharge above condensation water collection ring 215, an upper end of condensation water backflow pipe 216 is connected with a condensation water backflow inlet below condensation water collection ring 215, a lower end of condensation water backflow pipe 216 is connected with a storage water tank of the steam generating device in mount 201.

According to the present disclosure, a dust collection casing 217 is provided in the air suction chamber of ironing head 202 for filtering the air from air suction holes 208 into ironing apparatus 200, and dust collection casing 217 may be inserted into the air suction chamber from the lower portion of the ironing head housing. Air inlets are provided on a front portion of the dust collection casing and connected with air suction holes 208 on ironing panel 206, an air discharge port equipped with a filter screen is provided on a rear portion of dust collection casing 217.

When the present disclosure is implemented, the air suction hole may be provided in a groove on the front plate of ironing panel 206, it is advantage for absorption of the air by the air suction holes and for dust removing, thereby enhancing cleaning and dust-removing effect for the clothing.

Third Exemplary Embodiment

Figure 7:
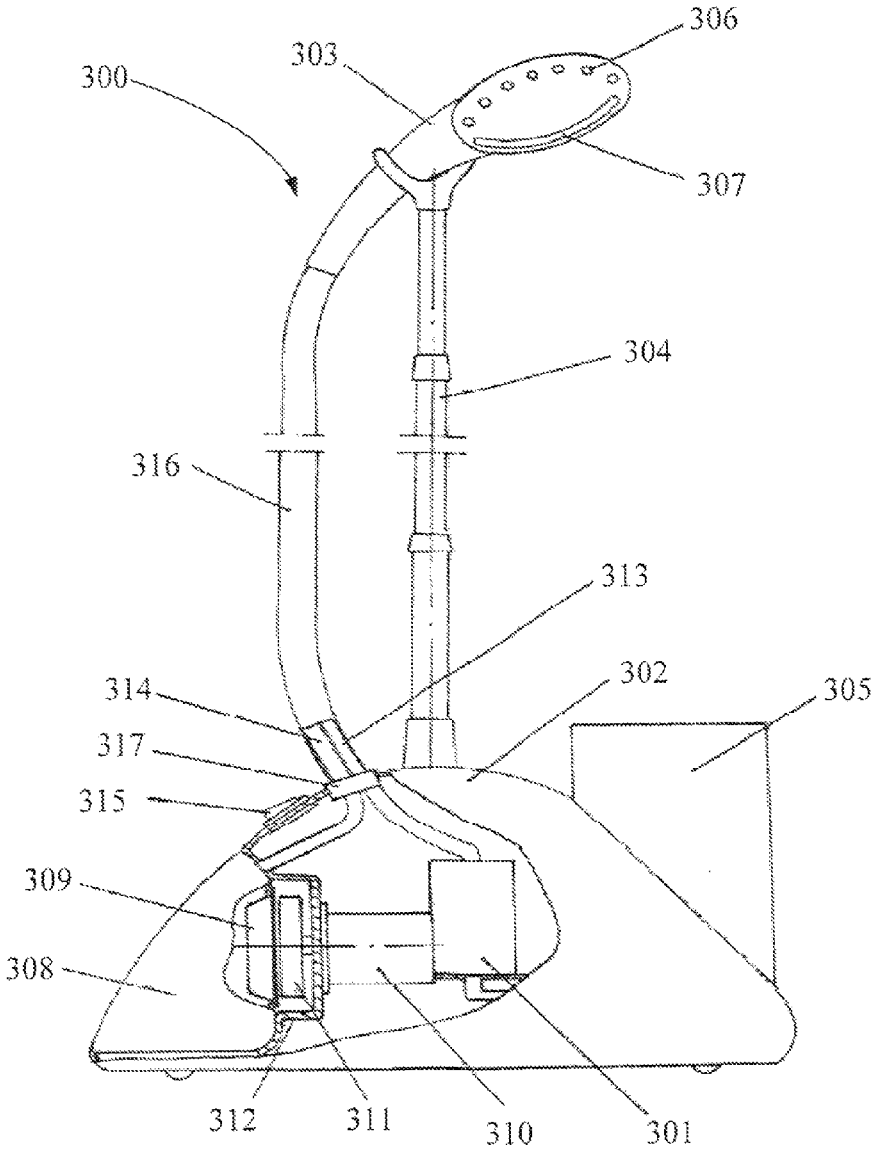
FIG. 7 illustrates a schematic elevated view and a partial cross-section view a mount of a configuration of the clothing steam ironing apparatus according to a third exemplary embodiment of present disclosure.

According to a third embodiment of the present disclosure, as shown in FIG. 7, a clothing steam ironing apparatus 300 includes a mount 302 for supporting clothing steam ironing apparatus 300, and a dust collection casing 308, which is provided in mount 302, includes a front plate and a rear plate. When dust collection casing 308 is mounted in mount 302, the front plate is arranged in the front of mount 302, and air discharges are provided on the rear plate. An air discharge passage is formed by the rear plate of dust collection casing 308 and a plate 312 having a groove cross-section, impellers 311 are provided in the discharge passage, and a motor 310 is connected with impellers 311 through the plate having the groove cross-section, for driving impellers 311. Both ends of the air discharge passage are respectively connected with air discharge ports of the housing of the mount.

More specifically, as illustrated in FIG. 7, the clothing steam ironing apparatus 300 having cleaning and dust-removing performance includes mount 302, which includes a steam generating device 301 therein and an ironing head 303. Steam generating device 301 may have an electric heat tube for heating. Moreover, mount 302 is formed by a flat mount plate and a housing with a protruding arc shape. A telescopic pole bracket 304 is provided on the middle portion of mount 302, and telescopic pole bracket 304 is formed by plurality of section hollow rods nested in assembly. A vertical storage water tank 305 is arranged on the rear portion of mount 302, and water tank 5 may be arranged on mount 302 by a plug-in mounting manner. Ironing head 303 includes an oblate ironing panel, and has its internal separated as a steam chamber and an air suction chamber by a separation plate, and steam ejection holes 306 communicating with the steam chamber and air suction holes 307 communicating with the air suction chamber are provided on the ironing panel of ironing head 303. The steam chamber and the air suction chamber of ironing head 303 in the embodiment shown in FIG. 7 are arranged as one is arranged above the other, and steam ejection holes 306 are plurality of circular holes and positioned on the upper portion of the ironing panel. Air suction holes 307 are formed as one curve elongate hole positioned on the lower portion of the ironing panel. The dust collection casing 8 is provided in the front of mount 302 by a plug-in mounting manner, a front plate of dust collection casing 308 is made of transparent material for observing the dust in the casing. And an air vent of dust collection casing 308 is opened on the middle of a rear plate of the dust collection casing, and a filter screen 309 is provided on the air vent of the dust collection casing. Moreover, a fan formed by motor 310 and impellers 311 is provided in mount 302 and located at a position corresponding to a position of the air vent of dust collection casing 308, and impellers 311 of the fan are provided in an air discharge passage formed by the rear plate of dust collection casing 308 and plate 312 having a groove cross-section, both ends of the air discharge passage are connected with air discharge ports provided on housings of both sides of mount 302 respectively. An upper end of a flexible steam pipe 313 is connected with steam chamber of ironing head 303, the lower end of flexible steam pipe 313 is connected with a steam outlet of steam generating device 301. And an upper end of a flexible air suction pipe 314 is connected with the air suction chamber of ironing head 303, and a lower end of flexible steam pipe 313 connects with an air inlet port of dust collection casing 308 provided on a rear of an upper portion of the dust collection casing.

According to the present disclosure, two rotary button controlling switches 315 are provided on the housing, having a protruding arc surface, of the mount 302, and are arranged as in a parallel arrangement or in an up-down arrangement. One of the two switches 315 is electrically connected with the motor 310 of the fan for controlling motor 310 of the fan and a speed of motor 310, and the other of the two witches 315 is electrically connected with the electric heat tube of the steam generating device 301 for controlling on and off of the heating of the generating device 301, and adjusting power of the heating.

According to the present disclosure, steam pipe 313 and air suction pipe 314 are provided in a flexible outer protective pipe 316.

According to the present disclosure, a pipe connection joint 317 is provided on the housing, having protruding arc surface, of mount 302, and is formed by a steam pipe connection joint and an air suction pipe connection joint extending out of a disk surface of a disk body at both ends thereof. Steam pipe 313 and air suction pipe 314 are connected and fixed on the outer portion and inner portion of mount 302 via pipe connection joint 317.

Specifically, the above embodiments are only the preferred embodiments of the present disclosure, and those skilled in the art may combine the technical features of the above embodiments to achieve other embodiments based on the teaching of the present disclosure, and the above embodiments would not limit the present disclosure.

Although several exemplary embodiments have been shown and described, it would be appreciated by those skilled in the art that various changes or modifications may be made in these embodiments without departing from the principles and spirit of the disclosure, the scope of which is defined in the appended claims and their equivalents.

What is claimed is:

1. A clothing steam ironing apparatus, comprising:

a mount including a steam generating device therein;

an ironing head including a steam chamber, which is branched into two steam passages in an ironing head housing, wherein the two steam passages are joined at rear ends to form an ironing head steam inlet interface, front ends of the two steam passages are communicated with an ironing head steam collection chamber formed by the ironing head housing and an ironing panel, inner sides of the two steam passages and the ironing head housing form an air suction chamber positioned at the middle of the ironing head;

a steam pipe connected with the steam generating device at one end and connected with the ironing head at an other end, wherein the steam pipe communicates with the ironing head steam inlet interface;

steam ejection holes communicating with the ironing head steam collection chamber are dispersedly formed in an upper portion of the ironing panel;

air suction holes communicating with the ironing head air suction chamber are formed in a lower portion of the ironing panel;

a dust collection casing is provided in the air suction chamber of the ironing head, wherein an air inlet port provided at a front end of the dust collection casing is connected with the air suction holes on the ironing panel, an air discharge port equipped with a filter screen is provided on a rear end of the dust collection casing, a centrifugal fan is provided behind the dust collection casing, and the centrifugal fan is formed by centrifugal impellers positioned in the front and a motor for the fan positioned in the rear;

air discharge ports are provided on an upper surface and a lower surface of the ironing head housing corresponding to the positions of the centrifugal impellers; and motor air vents are provided on the upper surface and the lower surface of the ironing head housing corresponding to the position of the fan motor.

2. The clothing steam ironing apparatus according to claim 1, further comprising:

a transverse groove separating the steam ejection holes from the air suction holes, wherein the transverse groove is formed at a front plate of the ironing panel and positioned between the steam ejection holes and the air suction holes.

3. The clothing steam ironing apparatus according to claim 1, further comprising:

a steam passage housing in the ironing head that is provided as a thermal insulation housing.

4. The clothing steam ironing apparatus according to claim 1, wherein the steam ejection holes and the air suction holes are circular holes, the steam ejection holes are arranged as a curve row along upper edge of the ironing panel, and the air suction holes are arranged as a curve row along lower edge of the ironing panel.

5. The vertical clothing steam ironing apparatus according to claim 4, wherein the steam pipe and the air suction pipe are provided in a flexible outer protective pipe.

6. The vertical clothing steam ironing apparatus according to claim 4, further comprising:

a pipe connection joint provided on the mount, wherein the pipe connection joint is formed by a steam pipe connection joint and an air suction pipe connection joint extending out of a disk surface of a disk body at both ends thereof.

7. The clothing steam ironing apparatus according to claim 1, wherein the air suction holes are formed as one transverse elongate air suction.

8. The clothing steam ironing apparatus according to claim 1, wherein the air suction holes are formed as one curve elongate air suction along lower edge of the ironing panel.

9. A vertical clothing steam ironing apparatus, comprising:

a mount including a steam generating device therein, wherein the mount is equipped with a vertical telescopic pole bracket and a storage water tank connected with the steam generating device;

an ironing head, which includes therein a steam chamber and an air suction chamber, which are separated from one another by a separation plate;

steam ejection holes communicating with the steam chamber;

air suction holes communicating with the air suction chamber are provided on the ironing panel of the ironing head;

a dust collection casing is provided in the front of the mount, wherein an air vent of the dust collection casing is provided on a rear plate of the dust collection casing;

a fan constituted by a motor and impellers is provided in the mount and located at a position corresponding to a position of the air vent of the dust collection casing, wherein the impellers are provided in an air discharge passage formed by a rear plate of the dust collection casing and a plate having a groove cross-section, both ends of the air discharge passage are connected with air discharge ports provided on the housing at both sides of the mount respectively;

a flexible steam pipe has one end connected with a steam chamber of the ironing head and the other end connected with a steam outlet of the steam generating device; and a flexible air suction pipe has one end connected with the air suction chamber of the steam head and the other end connected with a dust collection casing air inlet port provided on an upper portion of the dust collection casing.

10. The vertical clothing steam ironing apparatus according to claim 9, further comprising;

a condensation water collection ring provided at a lower portion of the steam chamber in the ironing head, wherein the upper end of the steam pipe is connected with a steam outlet above the condensation water collection ring; and a flexible condensation water backflow pipe is provided in the flexible outer sleeve, wherein an upper end of the condensation water backflow pipe is connected with a condensation water backflow inlet below the condensation water collection ring, and a lower end of the condensation water backflow pipe is connected with a storage water tank of the steam generating device in the mount.

11. The vertical clothing steam ironing apparatus according to claim 9, wherein the steam ejection holes are circular holes arranged as a curve row along upper edge of the ironing panel; and the air suction holes are arranged as an elongate air suction hole along lower edge of the ironing panel.

12. The vertical clothing steam ironing apparatus according to claim 9, further comprising:

a dust collection casing provided in the air suction chamber of the ironing head;

air inlets are provided on a front portion of the dust collection casing and connected with the air suction holes on the ironing panel; and an air discharge port equipped with a filter screen is provided on a rear portion of the dust collection casing.

13. The vertical clothing steam ironing apparatus according to claim 9, further comprising;

a sliding plate type air suction adjustment door provided on the ironing head.

14. The clothing steam ironing apparatus according to claim 1, wherein the panel of the ironing head includes a groove by which the panel is divided into two parts as an upper part on which the steam holes are provided and a lower part on which the air suction holes are provided.

15. A clothing steam ironing apparatus according to claim 1, further comprising:

a mount for supporting the clothing steam ironing apparatus, wherein the dust collection casing is provided in the mount and includes a front plate and a rear plate, the front plate being arranged in the front of the mount;

air outlets provided on the rear plate when the dust collection casing is mounted in the mount, wherein the air outlets are communicated with an air discharge passage; and a fan is arranged in the air discharge passage, wherein both ends of the air discharge passage are respectively connected with air discharge ports of the housing of the mount.

16. The vertical clothing steam ironing apparatus according to claim 9, wherein the ironing panel is an electric heat ironing panel.

17. The clothing steam ironing apparatus according to claim 9, further comprising:

a steam ejection hole extending pipe provided in an inner side of the ironing panel and connected with the steam ejection holes.

18. The clothing steam ironing apparatus according to claim 17, further comprising:

a steam chamber provided in the ironing head, wherein the steam chamber is communicated with the steam pipe; and a condensation water collection ring is provided at a lower portion of the steam chamber, wherein an upper end of the steam pipe is configured to be connected with steam outlets of the condensation water collection ring, and a condensation water backflow inlet of the condensation water collection ring is connected with an upper end of a condensation water backflow pipe, and a lower end of the condensation water backflow pipe is connected with a storage water tank in the mount.

19. A vertical clothing steam ironing apparatus, comprising:

a mount including a steam generating device therein;

an ironing head connected with the mount via a flexible outer sleeve, wherein the ironing head includes an ironing panel, steam ejection holes communicating with a steam chamber of the ironing head are formed in an upper portion of the ironing panel, air suction holes communicating with an air suction chamber of the ironing head are formed in a lower portion of the ironing panel, a transverse steam blocking groove is provided between the steam ejection holes and the air suction holes on a front plate of the ironing panel;

a dust collection device is provided in the mount, wherein an air discharge port of the dust collection device is connected with a fan, an air discharge port cooperating with the fan is provided on the mount; and a flexible steam pipe and an air suction pipe are provided in the flexible outer sleeve, wherein an upper end of the steam pipe is connected with the steam chamber of the ironing head, and a lower end of the steam pipe is connected with a steam outlet of the steam generating device in the mount, an upper end of the air suction pipe is connected with the air suction chamber of the ironing head, and a lower end of the air suction pipe is connected with an air inlet of the dust collection device in the mount.

20. A clothing steam ironing apparatus, comprising:

an ironing head for ironing clothing to be ironed, a steam chamber provided in the ironing head, wherein the steam chamber includes two steam passages extending from an ironing head housing and a steam collection chamber, rear ends of the steam passages are formed into one passage and connected with an steam pipe, front ends of the steam passages are connected with the steam collection chamber, and the steam collection chamber is communicated with steam outlets in a panel of the ironing head;

an air suction chamber provided in the ironing head, wherein the air suction chamber is formed by inner sides of the steam passages and the housing of the ironing head, and the air suction chamber is communicated with air suction holes of the panel of the ironing head; and a dust collection casing is provided in the air suction chamber for collecting dust from the air suction holes.

* * * * *